US007695158B2

(12) United States Patent
Kawabe

(10) Patent No.: US 7,695,158 B2
(45) Date of Patent: Apr. 13, 2010

(54) LED DEVICE WITH PLURAL COLOR CHIPS INCLUDING AT LEAST A YELLOW CHIP, A COLOR IMAGE DISPLAY UTILIZING THE LED DEVICE, LIGHT FOR TRAFFIC ALARM UTILIZING THE COLOR IMAGE DISPLAY, AND TRAFFIC ALARM UTILIZING THE LIGHT AND HAVING ARROW MARK DISPLAY

(76) Inventor: Syouji Kawabe, 711, 26-2, tachibana 1-chome, Sumida-ku, Tokyo, 131-0043 (JP)

( * ) Notice: Subject to any disclaimer, the term of this patent is extended or adjusted under 35 U.S.C. 154(b) by 185 days.

(21) Appl. No.: 11/887,256

(22) PCT Filed: Apr. 4, 2006

(86) PCT No.: PCT/JP2006/307516

§ 371 (c)(1),
(2), (4) Date: Oct. 18, 2007

(87) PCT Pub. No.: WO2006/115019

PCT Pub. Date: Nov. 2, 2006

(65) Prior Publication Data

US 2008/0137330 A1 Jun. 12, 2008

(30) Foreign Application Priority Data

Apr. 4, 2005 (JP) ..... 2005-132991

(51) Int. Cl.
*F21V 9/00* (2006.01)

(52) U.S. Cl. ..... 362/231; 362/212; 362/240

(58) Field of Classification Search ..... 362/27, 362/231, 211, 212, 249.14, 240, 800, 230, 362/802, 555
See application file for complete search history.

(56) References Cited

U.S. PATENT DOCUMENTS

| | | | | |
|---|---|---|---|---|
| 6,054,932 | A * | 4/2000 | Gartner et al. | 340/815.65 |
| 6,850,169 | B2 * | 2/2005 | Manavi et al. | 340/902 |
| 7,434,968 | B2 * | 10/2008 | Wu | 362/375 |
| 7,478,923 | B2 * | 1/2009 | Hsu | 362/231 |

FOREIGN PATENT DOCUMENTS

| | | |
|---|---|---|
| JP | H10-004216 | 1/1998 |
| JP | H10-91083 | 4/1998 |
| JP | 2001-236596 | 8/2001 |
| JP | 2002-2260175 | 9/2002 |

* cited by examiner

*Primary Examiner*—John A Ward
(74) *Attorney, Agent, or Firm*—Manabu Kanesaka

(57) ABSTRACT

A LED device for clear emission color by a plural color chips, essentially including a yellow color chip is provided. The LED device is utilized a color image display, and by this display, a light for traffic alarm and a light for traffic alarm with arrow mark which indicates the direction are accomplished.

6 Claims, 7 Drawing Sheets

LED DEVICE WITH PLURAL COLOR CHIPS INCLUDING AT LEAST A YELLOW CHIP, A COLOR IMAGE DISPLAY UTILIZING THE LED DEVICE, LIGHT FOR TRAFFIC ALARM UTILIZING THE COLOR IMAGE DISPLAY, AND TRAFFIC ALARM UTILIZING THE LIGHT AND HAVING ARROW MARK DISPLAY

LED device with plural color chips including at least a yellow chip, a color image display utilizing the LED device, a light for a traffic signal utilizing the color image display, and a traffic signal utilizing the light and having an arrow mark display

BACKGROUND OF THE INVENTION AND RELATED ART STATEMENT

This invention relates to a LED device accomplishing a clear light color with the plural color chips, and a color image display utilizing the LED device, and further this invention is to provide a traffic signal by a single light emitting the blue color, yellow color, red color, and an arrow mark direction signal, utilizing a plurality the LED devices.

One sort of conventional LED device has a red color chip, a green color chip, and a blue color chip, which are three primary color chips, and multiple colors are emitted by the mixture of three primary colors as a singular device.

By the way, a traffic signal has three lights, i.e., blue light, yellow light, and red light, and further may include a blue arrow mark light. Hence the signal is provided with plural lights. When LED device is used in the traffic signal light, a respective light emits single color. Accordingly three kinds of lights are required for emitting the blue light, the yellow light, and the red light.

By the prior conventional device, the yellow color must be emitted by the mixture of primary colors. But the mixed yellow color is somber and the color is rather orange-like. Namely, it is very difficult to obtain a clear yellow color.

Further, the traffic signal has plural lights, i.e., a blue light, a yellow light, a red light, and a blue arrow mark light. By this arrangement, the weight of the traffic signal is increased. Still more, it may be difficult to determine the color of the signal at a glance. When the signal receives the sun beam, the beam may be reflected and make the signal more indistinct.

To simplify the traffic signal, it may be considered to utilize the LED device which can emit multiple colors by the mixture of the primary colors. But the yellow color or attention color is not clear, and for this reason the traffic signal by above LED device is not realized.

SUMMARY OF THE INVENTION

This invention is to solve the above subject matter brought by the prior art. By this invention, a single LED device emits plural colors by providing plural color emission chips in the cell. To utilize this multi-color. LED device, the traffic signal or the color image display is simple and has a high performance.

Especially, as to the application of the LED device to the traffic signal, many LED devices of this invention are used to form a single light. The lights include a blue color light, a yellow (orange) color light, a red color light, and a blue arrow mark light. In this invention the functions of above plural lights are achieved by a common and single light. Further, since the blue arrow mark is shown on arbitrary time by the devices in the circle of light or by partially utilizing the devices in the circle, an indication of the direction by the arrow mark can be optionally shown.

The more concrete description of this invention is shown as follows.

(1) A LED device with plural color chips, wherein the device essentially includes a yellow color chip for emitting a singular yellow color beam which can not be obtained as a clear color by the mixture of the beams of plural color chips, and other color beam emitting chips.

(2) A LED device defined in term (1), wherein said other color beam emitting chips are red color chips and blue color chips.

(3) A LED device defined in term (1), wherein said other color beam emitting chips are primary color chips, i.e. red, green, and blue color chips.

(4) A LED device defined in term (2), wherein said device includes a circuit for operating the blue color chip, yellow color chip, and red color chip to emit regularly in order resulting in the three clear color emission without a mixture of the different color beam, and can be usable for a light beam display of the traffic signal.

(5) A color image display for color still image or color moving image, wherein a number of LED devices defined in term (3) are arranged and controlled by the control circuit, a respective LED device acts as a display element of the color display, and the emitting color by the color chips themselves and the mixture of the color beams by the plural color chips are clear color.

(6) A traffic signal made of a singular light display which has a plural LED device defined in term (2), wherein the LED device includes a blue color chip (KBL), a yellow color chip (KYL), and a red color chips (KRL).

(7) A traffic signal made of a singular light display having a plurality of LED devices defined in term (2), wherein an arrow mark is formed in the light or a partial portion of the arrow mark is formed in the light for showing a blue direction indicating arrow mark.

According to a LED device with plural color chips, the device essentially includes a yellow color chip for emitting a singular yellow color beam which can not be obtained as clear color by the mixture of the beams of plural color chips, and other color beam emitting chips, whereby clear light beams can be obtained by a respective singular color chip, and clear light beams can be also obtained by the mixture of the light beams of plural color chips even utilizing light emission diode (LED).

According to the LED device including a yellow color chip, red color chips and blue color chips as other color beam emitting chips, clear red, yellow, and blue light beams can be obtained by respective color chips', and reliable application to the traffic signal can be accomplished by the three clear color beams.

According to the LED device including the yellow color chip and other color beam emitting chips including primary color chips, i.e. red, green, and blue color chips, a clear yellow color which was not clear by the mixture of the primary color beams of the light emission diode can be obtained, and other many color beams can be obtained by the mixture of the three primary color chips, thereby realizing a color image display having all clear colors display ability.

According to the LED device which includes a circuit for emitting the blue color chip, yellow color chip, and red color chip regularly in order resulting in the three clear colors without the mixture of the different color beams, the LED device can be usable for the light beam display of the traffic signal by a single light made of plural LED devices of this invention, and a traffic signal of a simple apparatus which emits three essential signal colors can be accomplished.

According to the color image display for color still image or color moving image, in which a number of LED devices are arranged and controlled by the control circuit, the respective LED device acts as a display element of the color display, the emitting color by the color chips themselves and the mixture of the color beams by the plural color chips are clear color, and a new color still and moving image display apparatus will be provided. The apparatus is bright and clear so as to be adoptable to the outdoor advertising display, and an electric power can be saved.

Since a traffic signal comprises a singular light display which has a plurality of the LED devices and the LED device includes a blue color chip (KBL), a yellow color chip (KYL), and a red color chips (KRL)', a very simple traffic signal can be manufactured.

A traffic signal comprises a singular light display having a plurality of LED device, and an arrow mark is formed in the light or a partial portion of the arrow mark is formed in the light for showing a blue direction indicating arrow mark. Therefore, a traffic signal of a very simple structure can be provided, and the signal can indicate the indication or the other information.

DETAILED DESCRIPTION OF THE PREFERRED EMBODIMENTS

Figure 1:
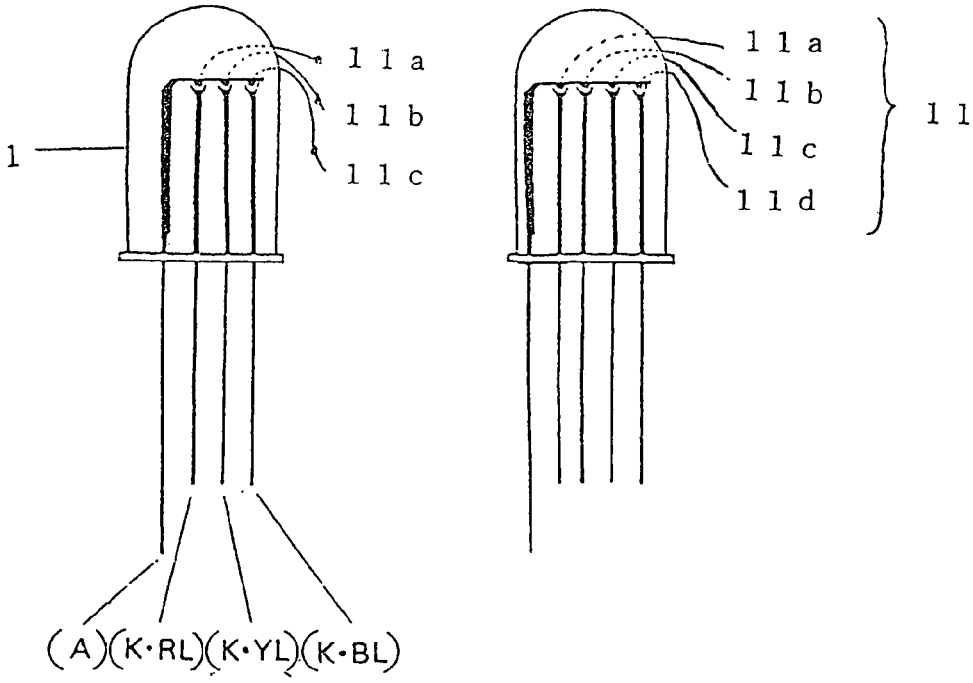
FIG. 1 is an internal front view of a LED device with blue, yellow, and red color chips therein.

A concrete embodiment of this invention will now be described referring to the drawings.

In drawings, numeral 1 denotes a LED device, numeral 2 denotes a relay timer, numeral 3 denotes a light, numeral 4 denotes an arrow mark, numeral 5 denotes a traffic signal, numeral 6 denotes a dial for blue color, numeral 7 denotes a dial for yellow color, numeral 8 denotes a dial for red color, numeral denotes 9 denotes a dial for arrow mark, numeral 10 denotes a circuit board, numeral 11 denotes a color emission chip, numeral 11*a* denotes a red color emission chip, numeral 11*b* denotes a yellow color emission chip, numeral 11*c* denotes a blue color emission chip, and numeral 11*d* denotes a green color emission chip.

FIG. 1 shows a LED device in which three light source chips, i.e., a blue color chip (KBL) 11*c*, a yellow color chip (KYL) 11*b*, and a red color chips (KRL) 11*a* are arranged. FIG. 1 further shows other LED device in which four light source chips, i.e., blue color chips (KBL) 11*c*, a yellow color chips (KYL) 11*b*, and a red color chips (KRL) 11*a*, a green color chips (KGL) are arranged.

A light or a display unit is manufactured from the plural of LED devices. The light or display unit is utilized as a light of a traffic signal. All the functions of the traffic signal including the indication of the direction by blue arrow mark can be performed by a singular light. The blue arrow mark is formed in the circle of the light or is formed partially in the circle of the light and the top of the arrow mark is projected outside of the circle of the light.

Figure 2:
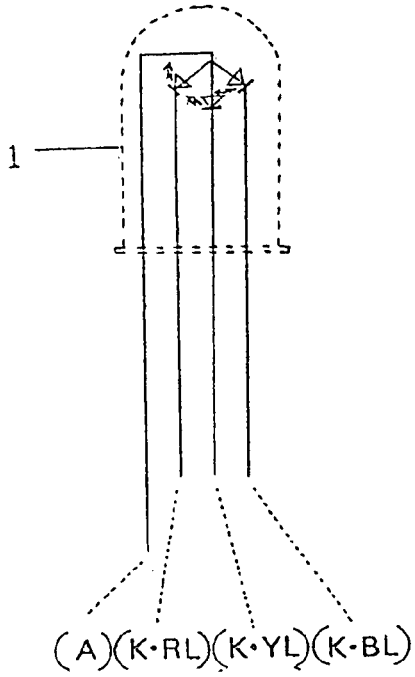
FIG. 2 is a circuit diagram of the LED device with blue, yellow, and red color chips therein.

FIG. 2 is a circuit diagram of a LED device with blue, yellow, and red color chips therein.

Figure 3:
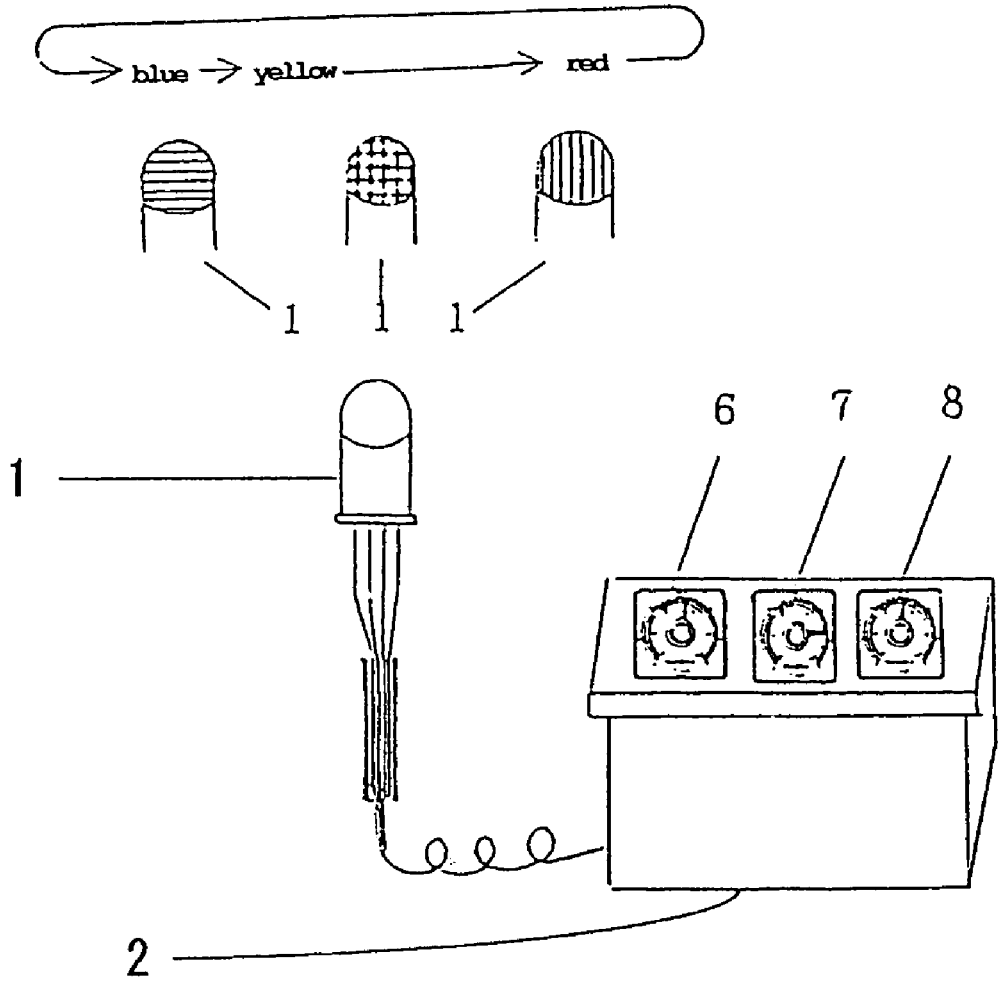
FIG. 3 is a front view of the LED device connected with a relay timer for operating the device to emit blue, yellow, and red sequentially.

FIG. 3 is a front view of the LED device connected with a relay timer for operating the device to emit blue, yellow, and red lights sequentially.

Figure 4:
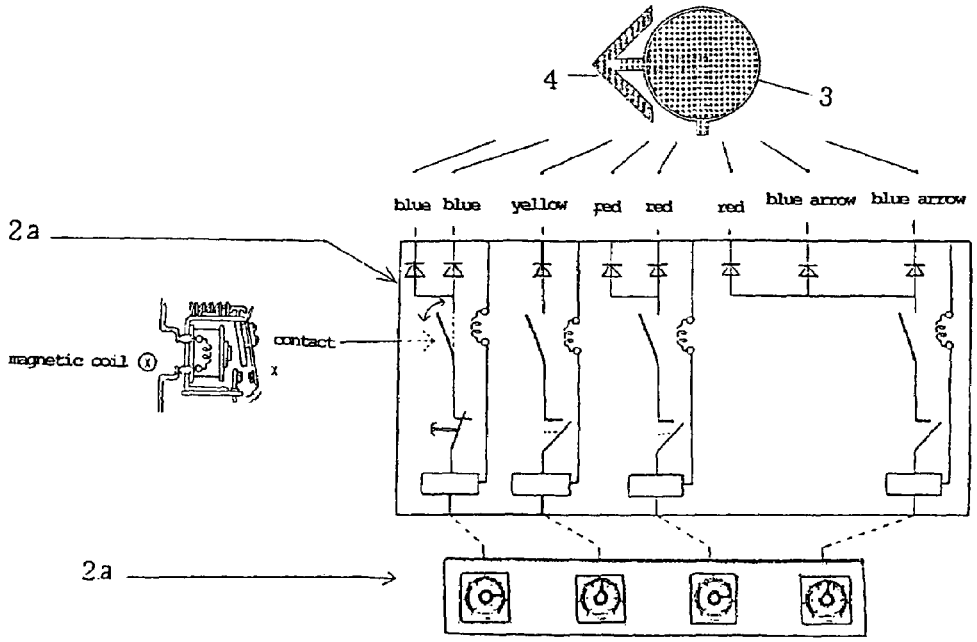
FIG. 4 is a circuit diagram of the relay timer for alternating the emitting colors of a light.

FIG. 4 is a circuit diagram of the relay timer for alternating the emitting colors of a light.

Figure 5:
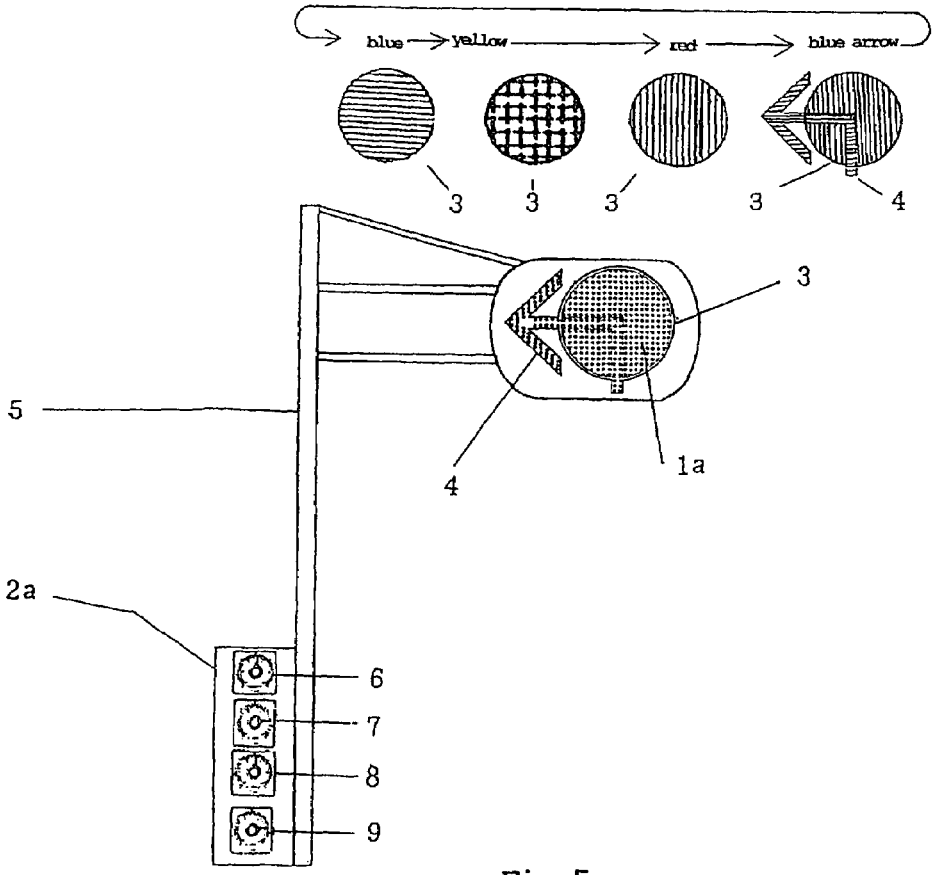
FIG. 5 is a front view of a traffic signal having the relay timer for operating the traffic signal to emit blue color, yellow color, red color, and blue arrow mark sequentially.

FIG. 5 is a front view of a traffic signal having the relay timer for emitting blue color, yellow color, red color, and blue arrow mark sequentially. The color chips in the LED device emit blue beam, yellow beam, red beam, and blue beams forming arrow mark in order by the relay timer 2*a* as shown in FIG. 5. When the arrow mark is formed from the blue color, the other portion in the light circle forms red color (or yellow color), and projected portion of the arrow mark projected from the circle of the light is blue color. In this case, the projected portion is made from the LED devices which have a blue color chip only.

Figure 6:
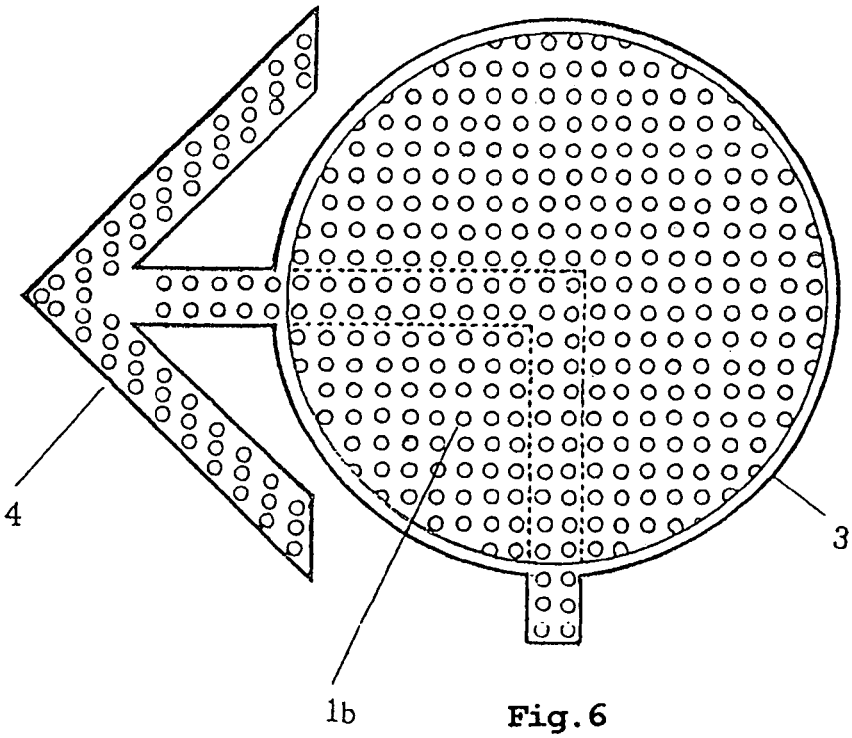
FIG. 6 is a front view of a light in which plural LED devices are arranged, and an arrow mark is formed by the common LED device, the top of the arrow mark being projected from the circle of the light.
Figure 7:
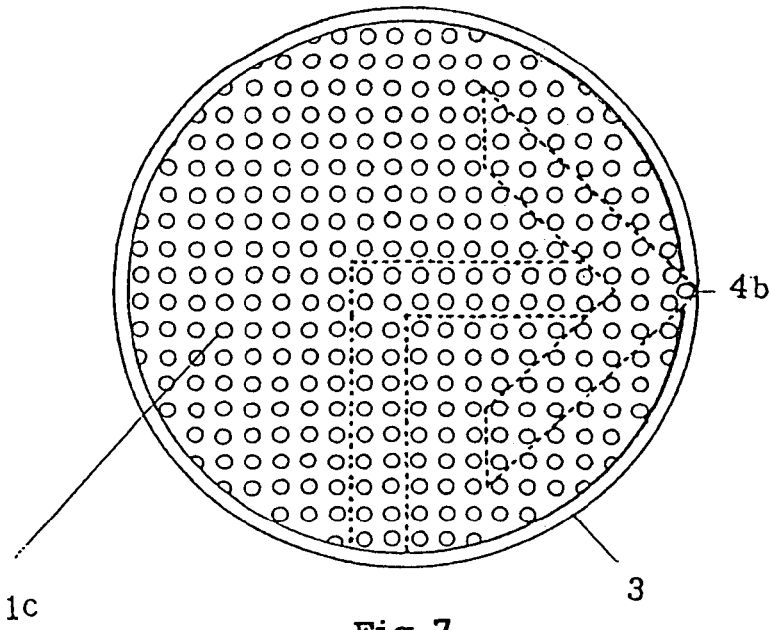
FIG. 7 is a front view of a light in which the plural LED devices are arranged, and an arrow mark is formed inside the circle of the light.
Figure 8:
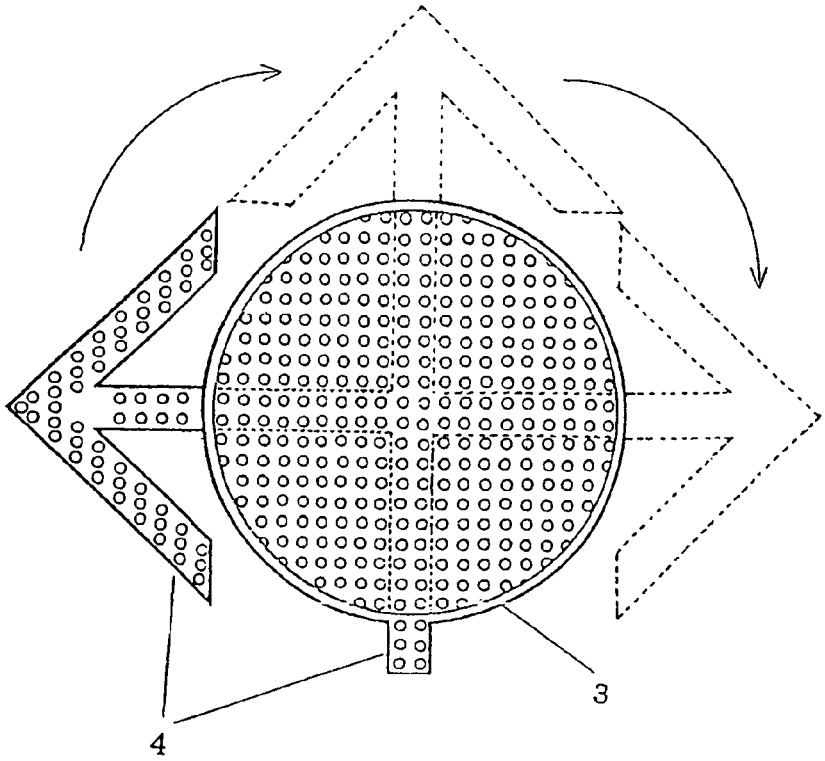
FIG. 8 is a front view of a light showing the movement of the arrow mark of the left direction to straight and right directions.
Figure 9:
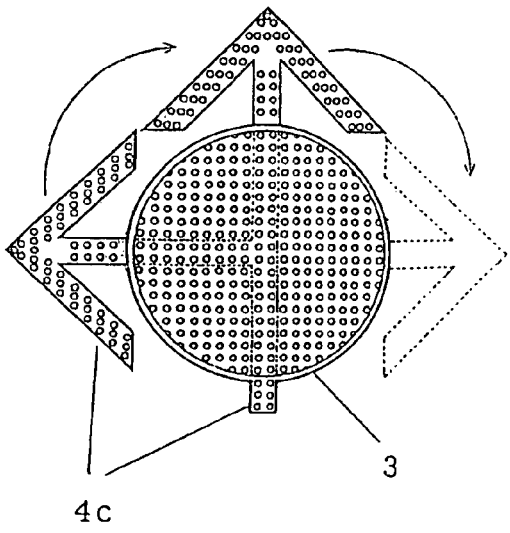
FIG. 9 is a front view of a light showing the movement of the arrow marks of the left and straight directions to straight and right directions.
Figure 10:
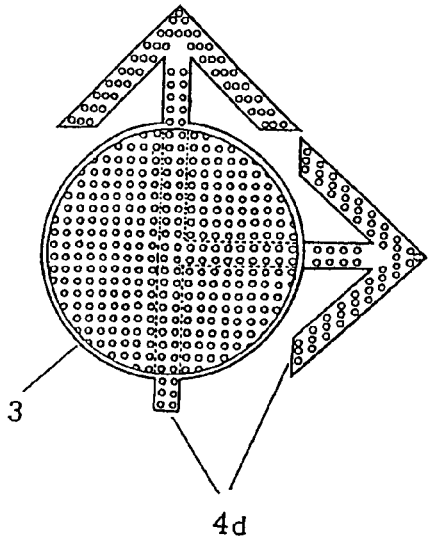
FIG. 10 is a front view of a light with two arrow marks showing straight and right directions respectively.

FIG. 6 is a front view of a light in which plural LED devices are arranged, and an arrow mark is formed by the common LED device, the top of the arrow mark being projected from the circle of the light. FIG. 7 is a front view of a light in which plural LED devices are arranged, and an arrow mark is formed inside the circle of the light. FIG. 8 is a front view of a light showing the movement of the arrow mark of the left direction to straight and right directions. FIG. 9 is a front view of a light showing the movement of the arrow marks of the left and straight directions to straight and right directions. FIG. 10 is a front view of a light with two arrow marks showing straight and right directions respectively.

The blue arrow mark can be formed at an arbitrary time, and in an arbitrary direction.

The time differences of every color can be controlled by the dials 6, 7, 8, 9.

The circuit includes a timer for sequence control, having magnetic relays and magnetic contacts, thus resulting in the recognition of the operation. Diodes are connected to the device for preventing the reverse flow of electric current.

Figure 11:
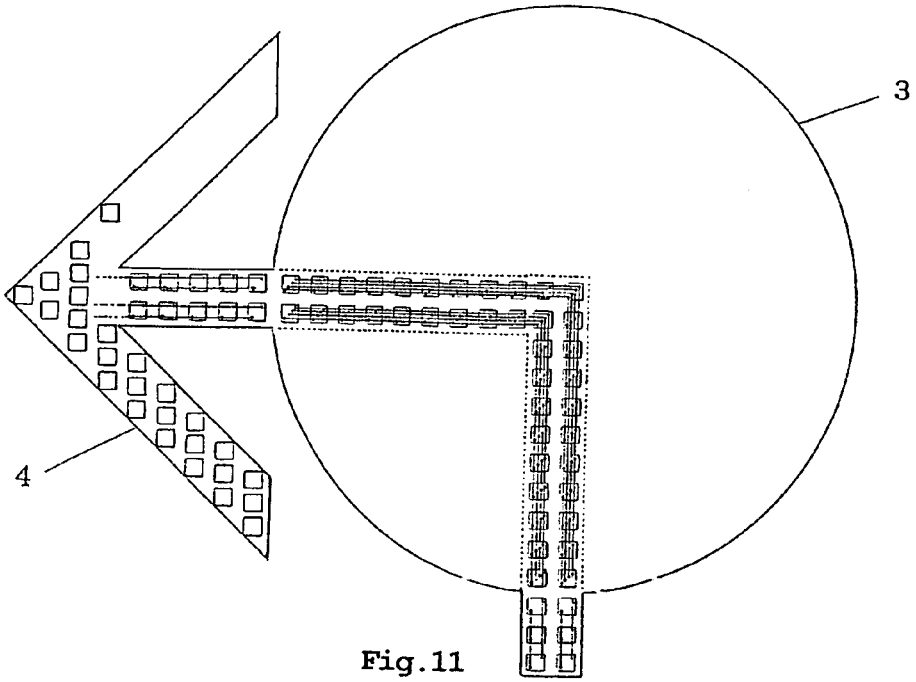
FIG. 11 is a rear view of a light showing the electric connection of terminals of the LED devices forming an arrow mark of a left direction.

FIG. 11 is a rear view of a light showing the electric connection of terminals of the LED devices forming an arrow mark of a left direction.

Figure 12:
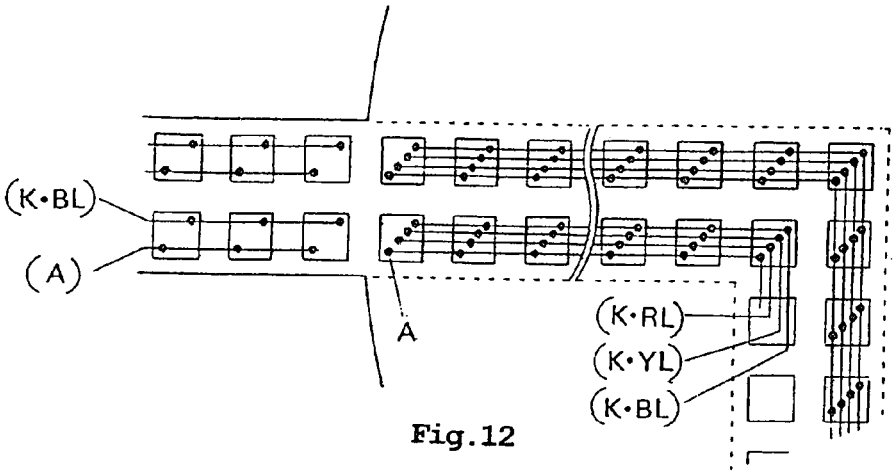
FIG. 12 is a circuit diagram for the LED devices (KRL)(KYL)(KBL) arranged in the circle of a light and the LED devices (KBL) arranged outside the circle of a light.

FIG. 12 is a circuit diagram for the LED devices (KRL) (KYL)(KBL) arranged in the circle of a light and the LED devices (KBL) arranged outside the circle of a light.

Figure 13:
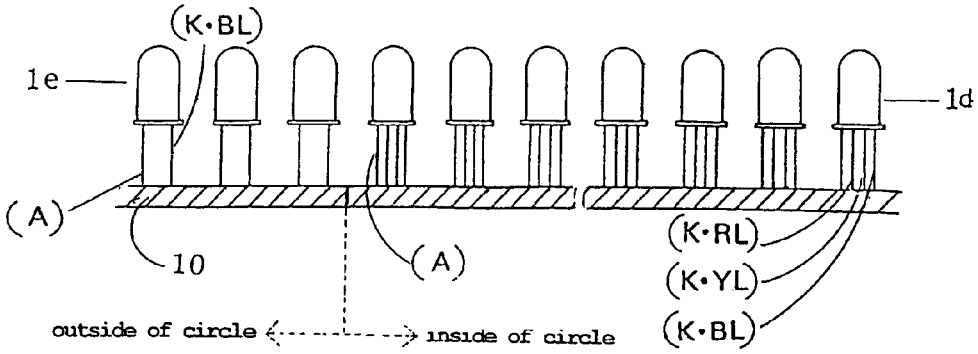
FIG. 13 is a front view of the LED devices mounted on the circuit board in the circle and outside of the circle of a light.

FIG. 13 is a front view of the LED devices mounted on the circuit board in the circle and outside of the circle of a light.

Figure 14:
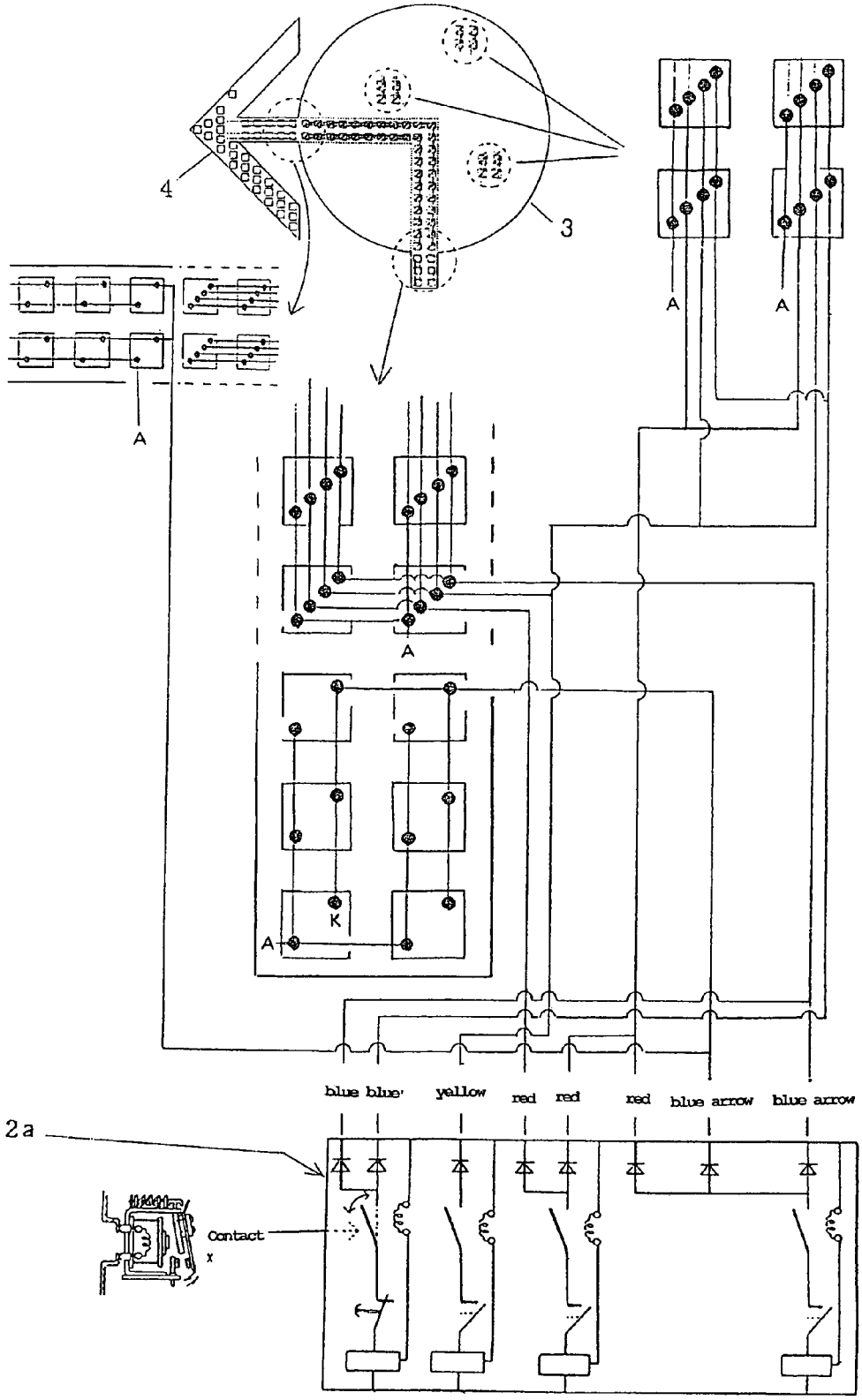
FIG. 14 is a substantially whole circuit diagram showing a magnetic relay having open and close contacts provided inside the relay timer, connecting the relay and the light.

FIG. 14 is a substantially whole circuit diagram showing a magnetic relay having open and close contacts provided inside the relay timer, connecting the relay and the light. Rear side circuit is shown in FIG. 14. In this circuit, the LED devices are connected so that electric current of respective color is not supplied simultaneously to the same LED device.

The above mentioned embodiment explains an embodiment in which a traffic signal is formed by a singular light with an arrow mark. When a yellow color chip is essentially provided, and further blue and red color chips are arranged in the LED device for single color element, the device may be utilized as a regular traffic signal which does not include blue arrow mark.

Further, as mentioned above, according to the LED device which includes essentially the yellow color chip, and further three primary color chips, i.e., blue, red, and green color chips, any colors are obtained in principle by the mixture of primary three color, and yellow color, which is not clear when synthesized by mixture, is shown clear by exclusive color chip.

Accordingly, by a control of a singular LED device, all colors are clearly shown by an operational control of a single LED device. Hence, by a display made of many LED devices of this invention, a full color display apparatus can be accomplished. The display apparatus can show every color clearly and can be used for still and moving picture displays.

INDUSTRIAL FIELD OF APPLICATION

The yellow color was not obtained clearly by the conventional mixture of three primary colors. According to the above mentioned invention, yellow color can surely and clearly be obtained. Further, as any colors can clearly be shown by a single LED device, a large-size color image display of LED device can be applied. Therefore, the display may be used as an outdoor advertising display.

Still more, this invention may be applied to a traffic signal, in which blue, yellow, and red colors should be clearly shown. In this application, a clear color is accomplished by a simple structure. By high brightness of this signal light, the color of the traffic signal is instantaneously recognized at a glance, and error recognition will be prevented even though the sun beam is reflected. Still further, the weight of the traffic signal will be lighten. The thickness of the light will be small, and hence dimension of the space for installing the traffic signal will be minimized.

Accordingly, this invention will have an excellent application on industrial purposes.

The invention claimed is:

1. A light for a traffic signal, comprising:

a plurality of LED devices, each of the LED devices comprising three color elements including a blue color chip, a yellow color chip, and a red color chip, wherein the three color chips emit respective color beams in order by a sequential control means, and a blue arrow mark is formed on said light when said light is red, a partial portion of said arrow mark is formed from the LED devices of said light, and a top of the arrow mark is projected outside of said light by an arrangement of the LED devices outside of said light.

2. A light according to claim 1, wherein said light has a circular housing and said plurality of LED devices are arranged in a circle of said housing.

3. A light according to claim 2, wherein said partial portion of said blue arrow mark is formed by the LED devices arranged in said circle of the housing of the light.

4. A light according to claim 2, wherein said top of the blue arrow mark is formed by the LED devices arranged outside of said circle of the housing.

5. A light according to claim 4, wherein the LED device arranged outside of said circle has the blue color chip and not other color chips, while the LED device arranged inside of said circle has the red color chip, the blue color chip, and the yellow color chip.

6. A light for a traffic signal, comprising:

a plurality of LED devices, each of the LED devices including a blue color chip, a yellow color chip, and a red color chip, and being controlled by a sequential control means to emit a respective color beam in order, wherein the LED devices are arranged to form a main light and a blue arrow mark overlapping with the main light when the main light is red, said blue arrow mark including a first tip portion facing a direction of the blue arrow mark, said tip portion projecting from the main light, and a middle portion between the first tip portion and a second tip portion opposite to the first tip portion, said middle portion being located inside the main light.

* * * * *